US006970820B2

(12) United States Patent
Junqua et al.

(10) Patent No.: US 6,970,820 B2
(45) Date of Patent: Nov. 29, 2005

(54) VOICE PERSONALIZATION OF SPEECH SYNTHESIZER

(75) Inventors: Jean-Claude Junqua, Santa Barbara, CA (US); Florent Perronnin, Santa Barbara, CA (US); Roland Kuhn, Santa Barbara, CA (US); Patrick Nguyen, Santa Barbara, CA (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 522 days.

(21) Appl. No.: 09/792,928

(22) Filed: Feb. 26, 2001

(65) Prior Publication Data

US 2002/0120450 A1 Aug. 29, 2002

(51) Int. Cl.[7] ..... G10L 13/00

(52) U.S. Cl. ..... 704/258; 704/266; 704/261; 395/25.9; 395/2

(58) Field of Search ..... 704/258, 246, 704/261, 266, 250, 262, 245, 255, 274; 395/2, 25.9; 705/17; 715/530; 359/430

(56) References Cited

U.S. PATENT DOCUMENTS 5,165,008 A * 11/1992 Hermansky et al. ..... 704/262
5,729,694 A * 3/1998 Holzrichter et al. ..... 705/17
5,737,487 A * 4/1998 Bellegarda et al. ..... 704/250
5,794,204 A * 8/1998 Miyazawa et al. ..... 704/275
6,073,096 A * 6/2000 Gao et al. ..... 704/245
6,253,181 B1 * 6/2001 Junqua ..... 704/255
6,341,264 B1 * 1/2002 Kuhn et al. ..... 704/255
6,571,208 B1 * 5/2003 Kuhn et al. ..... 704/250
2002/0091522 A1 * 7/2002 Bi et al. ..... 704/246

OTHER PUBLICATIONS

Chilin Shih et al: "Efficient Adaptation of TTS Duration Model to New Speakers" 1998 International Conference on Spoken Language Processing, Oct. 1998.

* cited by examiner

*Primary Examiner*—Susan McFadden
*Assistant Examiner*—Huyen X. Vo
(74) *Attorney, Agent, or Firm*—Harness, Dickey & Pierce, PLC

(57) ABSTRACT

The speech synthesizer is personalized to sound like or mimic the speech characteristics of an individual speaker. The individual speaker provides a quantity of enrollment data, which can be extracted from a short quantity of speech, and the system modifies the base synthesis parameters to more closely resemble those of the new speaker. More specifically, the synthesis parameters may be decomposed into speaker dependent parameters, such as context-independent parameters, and speaker independent parameters, such as context dependent parameters. The speaker dependent parameters are adapted using enrollment data from the new speaker. After adaptation, the speaker dependent parameters are combined with the speaker independent parameters to provide a set of personalized synthesis parameters. To adapt the parameters with a small amount of enrollment data, an eigenspace is constructed and used to constrain the position of the new speaker so that context independent parameters not provided by the new speaker may be estimated.

21 Claims, 5 Drawing Sheets

VOICE PERSONALIZATION OF SPEECH SYNTHESIZER

BACKGROUND AND SUMMARY OF THE INVENTION

The present invention relates generally to speech synthesis. More particularly, the invention relates to a system and method for personalizing the output of the speech synthesizer to resemble or mimic the nuances of a particular speaker after enrollment data has been supplied by that speaker.

In many applications using text-to-speech (TTS) synthesizers, it would be desirable to have the output voice of the synthesizer resemble the characteristics of a particular speaker. Much of the effort spent in developing speech synthesizers today has been on making the synthesized voice sound as human as possible. While strides continue to be made in this regard, the present day synthesizers produce a quasi-natural speech sound that represents an amalgam of the allophones contained within the corpus of speech data used to construct the synthesizer. Currently, there is no effective way of producing a speech synthesizer that mimics the characteristics of a particular speaker, short of having that speaker spend hours recording examples of his or her speech to be used to construct the synthesizer. While it would be highly desirable to be able to customize or personalize an existing speech synthesizer using only a small amount of enrollment data from a particular speaker, that technology has not heretofore existed.

Most present day speech synthesizers are designed to convert information, typically in the form of text, into synthesized speech. Usually, these synthesizers are based on a synthesis method and associated set of synthesis parameters. The synthesis parameters are usually generated by manipulating concatenation units of actual human speech that has been pre-recorded, digitized, and segmented so that the individual allophones contained in that speech can be associated with, or labeled to correspond to, the text used during recording. Although there are a variety of different synthesis methods in popular use today, one illustrative example is the source-filter synthesis method. The source-filter method models human speech as a collection of source waveforms that are fed through a collection of filters. The source waveform can be a simple pulse or sinusoidal waveform, or a more complex, harmonically rich waveform. The filters modify and color the source waveforms to mimic the sound of articulated speech.

In a source-filter synthesis method, there is generally an inverse correlation between the complexity of the source waveform and the filter characteristics. If a complex waveform is used, usually a fairly simple filter model will suffice. Conversely, if a simple source waveform is used, typically a more complex filter structure is used. There are examples of speech synthesizers that have exploited the full spectrum of source-filter relationships, ranging from simple source, complex filter to complex source, simple filter. For purposes of explaining the principles of the invention, a glottal source, formant trajectory filter synthesis method will be illustrated here. Those skilled in the art will recognize that this is merely exemplary of one possible source-filter synthesis method; there are numerous others with which the invention may also be employed. Moreover, while a source-filter synthesis method has been illustrated here, other synthesis methods, including non-source-filter methods are also within the scope of the invention.

In accordance with the invention, a personalized speech synthesizer may be constructed by providing a base synthesizer employing a predetermined synthesis method and having an initial set of parameters used by that synthesis method to generate synthesized speech. Enrollment data is obtained from a speaker, and that enrollment data is used to modify the initial set of parameters to thereby personalize the base synthesizer to mimic speech qualities of the speaker.

In accordance with another aspect of the invention, the initial set of parameters may be decomposed into speaker dependent parameters and speaker independent parameters. The enrollment data obtained from the new speaker is then used to adapt the speaker dependent parameters and the resulting adapted speaker dependent parameters are then combined with the speaker independent parameters to generate a set of personalized synthesis parameters for use by the speech synthesizer.

In accordance with yet another aspect of the invention, the previously described speaker dependent parameters and speaker independent parameters may be obtained by decomposing the initial set of parameters into two groups: context independent parameters and context dependent parameters. In this regard, parameters are deemed context independent or context dependent, depending on whether there is detectable variability within the parameters in different contexts. When a given allophone sounds differently, depending on what neighboring allophones are present, the synthesis parameters associated with that allophone are decomposed into identifiable context dependent parameters (those that change depending on neighboring allophones). The allophone is also decomposed into context independent parameters that do not change significantly when neighboring allophones are changed.

The present invention associates the context independent parameters with speaker dependent parameters; it associates context dependent parameters with speaker independent parameters. Thus, the enrollment data is used to adapt the context independent parameters, which are the re-combined with the context dependent parameters to form the adapted synthesis parameters. In the preferred embodiment, the decomposition into context independent and context dependent parameters results in a smaller number of independent parameters than dependent ones. This difference in number of parameters is exploited because only the context independent parameters (fewer in number) undergo the adaptation process. Excellent personalization results are thus obtained with minimal computational burden.

In yet another aspect of the invention, the adaptation process discussed above may be performed using a very small amount of enrollment data. Indeed, the enrollment data does not even need to include examples of all context independent parameters. The adaptation process is performed using minimal data by exploiting an eigenvoice technique developed by the assignee of the present invention. The eigenvoice technique involves using the context independent parameters to construct supervectors that are then subjected to a dimensionality reduction process, such as principle component analysis (PCA) to generate an eigenspace. The eigenspace represents, with comparatively few dimensions, the space spanned by all context independent parameters in the original speech synthesizer. Once generated, the eigenspace can be used to estimate the context independent parameters of a new speaker by using even a short sample of that new speaker's speech. The new speaker utters a quantity of enrollment speech that is digitized, segmented, and labeled to constitute the enrollment data.

The context independent parameters are extracted from that enrollment data and the likelihood of these extracted parameters is maximized given the constraint of the eigenspace.

The eigenvoice technique permits the system to estimate all of the new speaker's context independent parameters, even if the new speaker has not provided a sufficient quantity of speech to contain all of the context independent parameters. This is possible because the eigenspace is initially constructed from the context independent parameters from a number of speakers. When the new speaker's enrollment data is constrained within the eigenspace (using whatever incomplete set of parameters happens to be available) the system infers the missing parameters to be those corresponding to the new speaker's location within the eigenspace.

The techniques employed by the invention may be applied to virtually any aspect of the synthesis method. A presently preferred embodiment applies the technique to the formant trajectories associated with the filters of the source-filter model. That technique may also be applied to speaker dependent parameters associated with the source representation or associated with other speech model parameters, including prosody parameters, including duration and tilt. Moreover, if the eigenvoice technique is used, it may be deployed in an iterative arrangement, whereby the eigenspace is trained iteratively and thereby improved as additional enrollment data is supplied.

For a more complete understanding of the invention, its objects and advantages, refer to the following description and to the accompanying drawings.

DETAILED DESCRIPTION OF THE PREFERRED EMBODIMENTS

Figure 1:
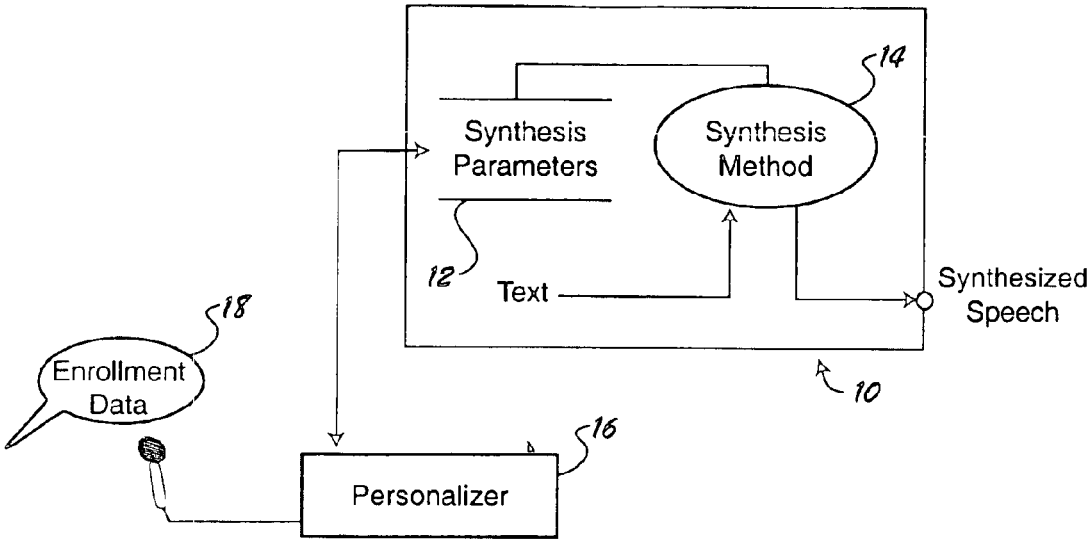
FIG. 1 is a block diagram of the personalized speech synthesizer of the invention.

Referring to FIG. 1, an exemplary speech synthesizer has been illustrated at 10. The speech synthesizer employs a set of synthesis parameters 12 and a predetermined synthesis method 14 with which it converts input data, such as text, into synthesized speech. In accordance with one aspect of the invention, a personalizer 16 takes enrollment data 18 and operates upon synthesis parameters 12 to make the synthesizer mimic the speech qualities of an individual speaker. The personalizer 16 can operate in many different domains, depending on the nature of the synthesis parameters 12. For example, if the synthesis parameters include frequency parameters such as formant trajectories, the personalizer can be configured to modify the formant trajectories in a way that makes the resultant synthesized speech sound more like an individual who provided the enrollment data 18.

Figure 2:
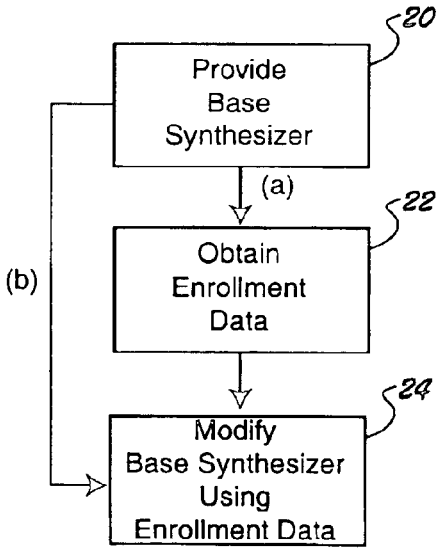
FIG. 2 is a flowchart diagram illustrating the basic steps involved in constructing a personalized synthesizer or in personalizing an existing synthesizer.

The invention provides a method for personalizing a speech synthesizer, and also for constructing a personalized speech synthesizer. The method, illustrated generally in FIG. 2, begins by providing a base synthesizer at step 20. The base synthesizer can be based upon any of a wide variety of different synthesis methods. A source-filter method will be illustrated here, although there are other synthesis methods to which the invention is equally applicable. In addition to providing a base synthesizer 20, the method also includes obtaining enrollment data 22. This enrollment data is then used at step 24 to modify the base synthesizer. When using the invention to personalize an existing synthesizer, the step of obtaining enrollment data is usually performed after the base synthesizer has been constructed. However, it is also possible to obtain the enrollment data prior to or concurrent with the construction of the base synthesizer. Thus in FIG. 2 two alternate flow paths (a) and (b) have been illustrated.

Figure 3:
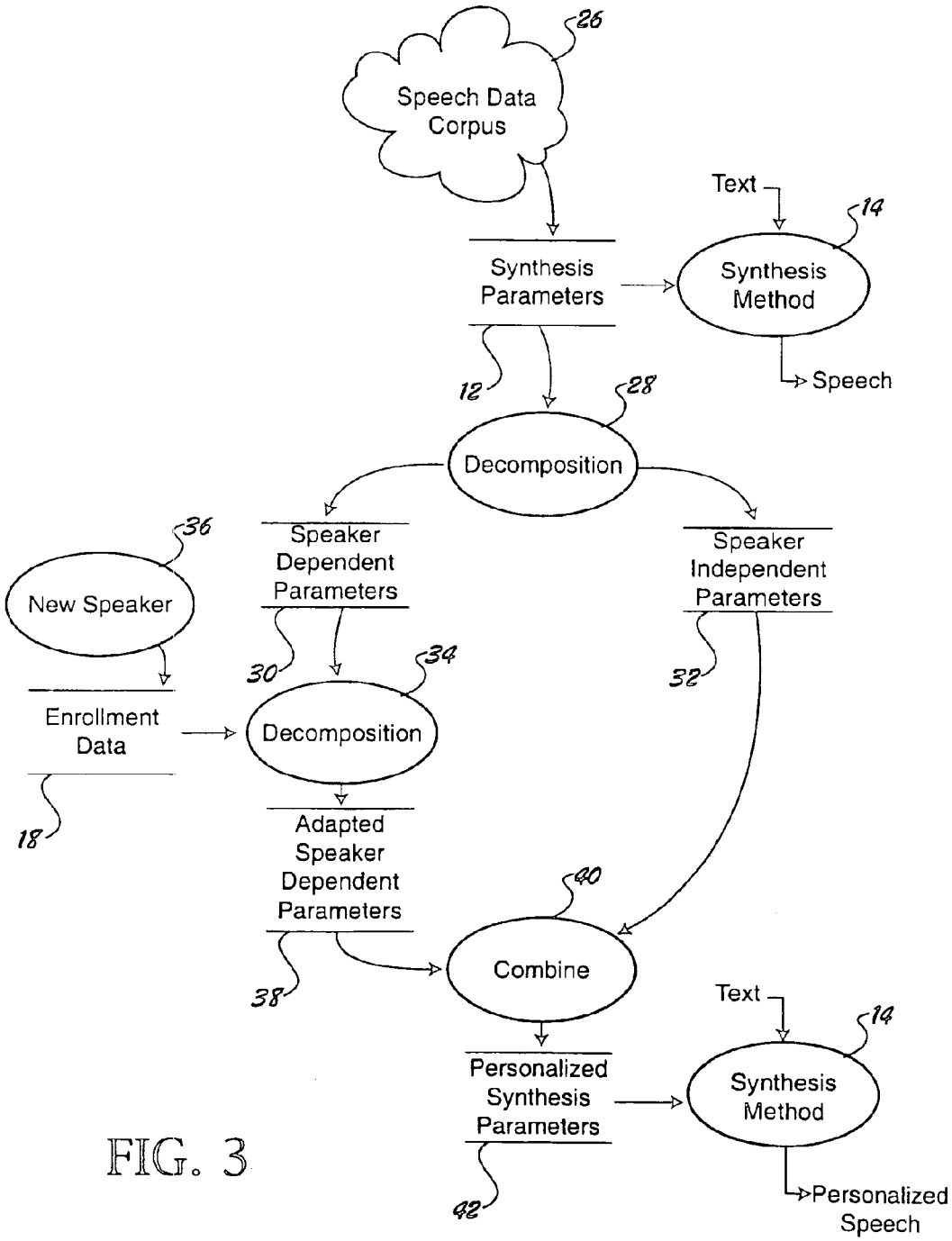
FIG. 3 is a data flow diagram illustrating one embodiment of the invention in which synthesis parameters are decomposed into speaker dependent parameters and speaker independent parameters.

FIG. 3 shows a presently preferred embodiment in greater detail. In FIG. 3 the synthesis parameters 12, upon which synthesis method 14 operates, originate from a speech data corpus 26. When constructing the base synthesizer it is common practice to have one or more training speakers provide examples of actual speech by reading from prepared texts. Thus the provided utterances can be correlated to the text. Usually the speech data is digitized and segmented into small pieces that can be aligned with discrete symbols within the text. In the presently preferred embodiment the speech data is segmented to identify individual allophones, so that the context of their neighboring allophones is preserved. Synthesis parameters 12 are then constructed from these allophones. In the presently preferred embodiment, time and frequency parameters, respectively, such as glottal pulses and formant trajectories are extracted from each allophone unit.

Once the synthesis parameters have been developed, a decomposition process 28 is performed. The synthesis parameters 12 are decomposed into speaker-dependent parameters 30 and speaker-independent parameters 32. The decomposition process may separate parameters using data analysis techniques or by computing formant trajectories for context-independent phonemes and considering that each allophone unit formant trajectory is the sum of two terms: context-independent formant trajectory and context-dependent formant trajectory. This technique will be illustrated more fully in connection with FIG. 4.

Once the speaker dependent and speaker independent parameters have been isolated from one another, an adaptation process 34 is performed upon the speaker dependent parameters. The adaptation process uses the enrollment data 18 provided by a new speaker 36, for whom the synthesizer will be customized. Of course, the new speaker 36 can be one of the speakers who provided the speech data corpus 26, if desired. Usually, however, the new speaker will not have had an opportunity to participate in creation of the speech data corpus, but is rather a user of the synthesis system after its initial manufacture.

There are a variety of different techniques that may be used for the adaptation process 34. The adaptation process understandably will depend on the nature of the synthesis parameters being used by the particular synthesizer. One possible adaptation method involves substituting the speaker dependent parameters taken from new speaker 36 for the originally determined parameters taken from the speech data corpus 26. If desired, a blended or weighted average of old and new parameters may be used to provide adapted speaker dependent parameters 38 that come from new speaker 36 and yet remain reasonably consistent with the remaining parameters obtained from the speech data corpus 26. In the ideal case, the new speaker 36 provides a sufficient quantity of enrollment data 18 to allow all context independent parameters, or at least the most important ones, to be adapted to the new speaker's speech nuisances. However, in a number of cases, only a small amount of data is available from the new speaker and all the context independent parameters are not represented. As will be discussed more fully below, another aspect of the invention provides an eigenvoice technique whereby the speaker dependent parameters may be adapted with only a minimal quantity of enrollment data.

After adapting the speaker dependent parameters, a combining process 40 is performed. The combining process 40 rejoins the speaker independent parameters 32 with the adapted speaker dependent parameters 38 to generate a set of personalized synthesis parameters 42. The combining process 40 works essentially by using the decomposition process 28 in reverse. In other words, decomposition process 28 and combination process 40 are reciprocal.

Once the personalized synthesis parameters 42 have been generated, they may be used by synthesis method 14 to produce personalized speech. In FIG. 3, note that the synthesis method 14 appears in two locations, illustrating that the method used upon synthesis parameters 12 may be the same method as used upon personalized synthesis parameters 42, the primary difference being that parameters 12 produce synthesized speech of the base synthesizer whereas parameters 42 produce synthesized speech that resembles or mimics new speaker 36.

Figure 4:
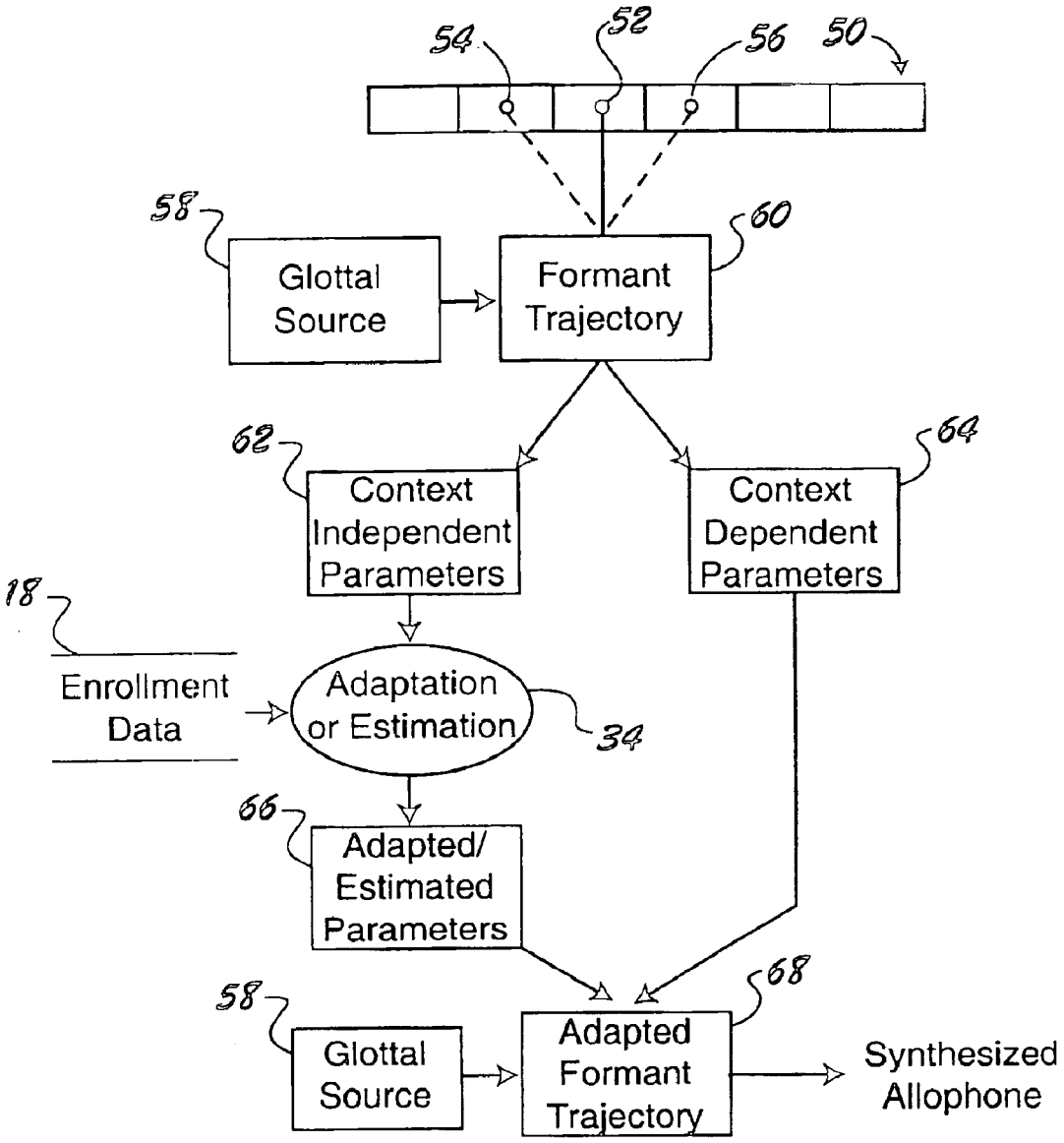
FIG. 4 is a detailed data flow diagram illustrating another preferred embodiment in which context independent parameters and the context dependent parameters are extracted from the formant trajectory of an allophone.

FIG. 4 shows, in greater detail, one embodiment of the invention, where the synthesis method is a source-filter method using formant trajectories or other comparable frequency-domain parameters. An exemplary concatenation unit of enrollment speech data is illustrated at 50, containing a given allophone 52, situated in context between neighboring allophones 54 and 56. In accordance with the source-filter model of this example, the synthesizer produces synthesized speech by applying a glottal source waveform 58 to a set of filters corresponding to the formant trajectory 60 of the allophones used to make up the speech.

As previously described in connection with FIG. 3, the synthesis parameters (in this case formant trajectories) may be decomposed into speaker dependent and speaker independent parameters. This embodiment thus decomposes the formant trajectory 60 into context independent parameters 62 and context dependent parameters 64. Note that the context independent parameters correspond to speaker dependent parameters; the context dependent parameters correspond to speaker independent parameters. Enrollment data 18 is used by the adaptation or estimation process 34 to generate adapted or estimated parameters 66. These are then combined with the context dependent parameters 64 to construct the adapted formant trajectory 68. This adapted formant trajectory may then be used to construct filters through which the glottal source waveform 58 is passed to produce synthesized speech in which the synthesized allophone now more closely resembles or mimics the new speaker.

As noted above, if the new speaker enrollment data is sufficient to estimate all of the context independent formant trajectories, then replacing the context independent information by that of the new speaker is sufficient to personalize the synthesizer output voice. In contrast, if there is not enough enrollment data to estimate all of the context independent formant trajectories, the preferred embodiment uses an eigenvoice technique to estimate the missing trajectories.

Figure 5:
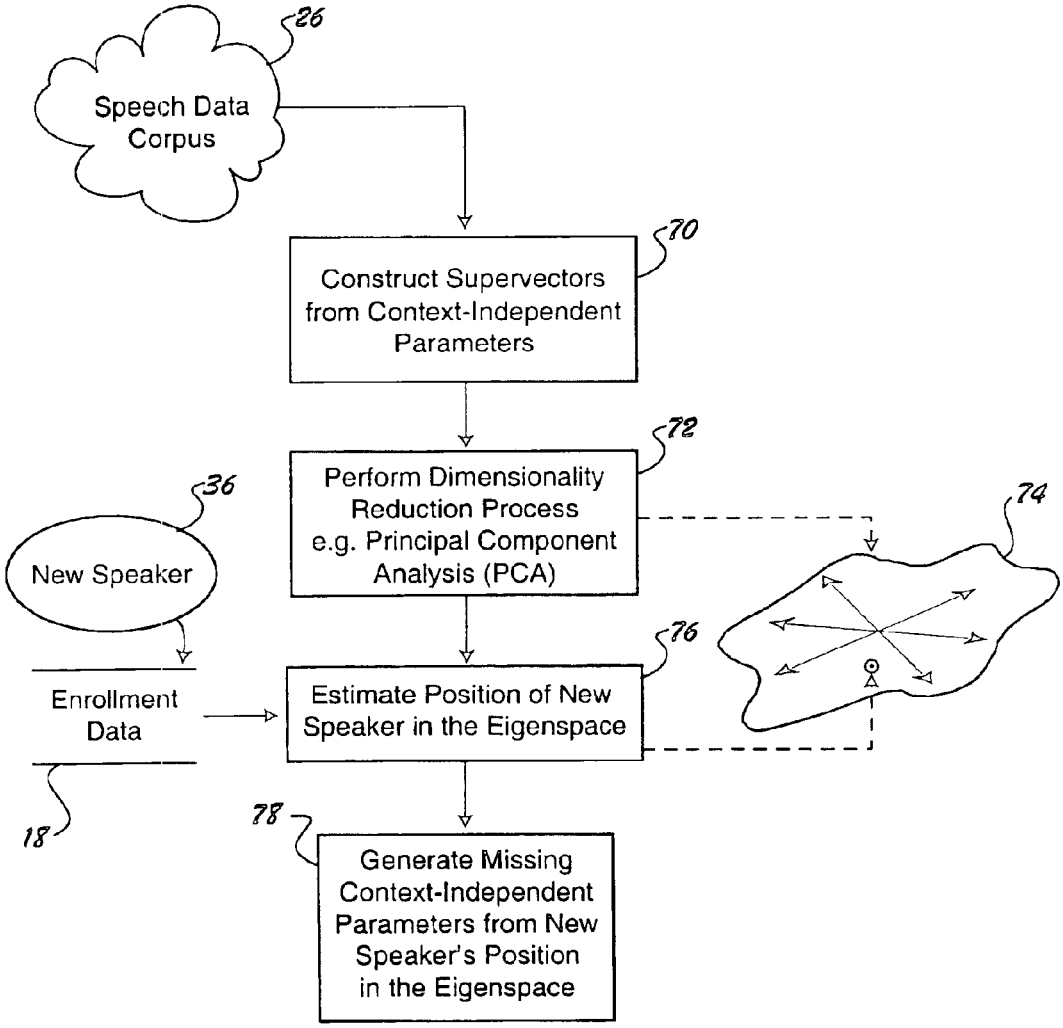
FIG. 5 is a block diagram illustrating the eigenvoice technique in its application of adapting or estimating parameters.

Illustrated in FIG. 5, the eigenvoice technique begins by constructing supervectors from the context-independent parameters of a number of training speakers, as illustrated at step 70. If desired, the supervectors may be constructed using the speech data corpus 26 previously used to generate the base synthesizer. In constructing the supervectors, a reasonably diverse cross-section of speakers should be chosen. For each speaker a supervector is constructed. Each supervector includes, in a predefined order, a concatenation of all context-independent parameters for all phonemes used by the synthesizer. The order in which the phoneme parameters are concatenated is not important, so long as the order is consistent for all training speakers.

Next, at step 72, a dimensionality reduction process is performed. Principal Component Analysis (PCA) is one such reduction technique. The reduction process generates an eigenspace 74, having a dimensionality that is low compared with the supervectors used to construct the eigenspace. The eigenspace thus represents a reduced-dimensionality vector space to which the context-independent parameters of all training speakers are confined.

Enrollment data 18 from new speaker 36 is then obtained and the new speaker's position in eigenspace 74 is estimated as depicted by step 76. The preferred embodiment uses a maximum likelihood technique to estimate the position of the new speaker in the eigenspace. Recognize that the enrollment data 18 does not necessarily need to include examples of all phonemes. The new speaker's position in eigenspace 74 is estimated using whatever phoneme data are present. In practice, even a very short utterance of enrollment data is sufficient to estimate the new speaker's position in eigenspace 74. Any missing phoneme data can thus be generated as in step 78 by constraining the missing parameters to the position in the eigenspace previously estimated. The eigenspace embodies knowledge about how different speakers will sound. If a new speaker's enrollment data utterance sounds like Scarlet O'Hara saying "Tomorrow is another day," it is reasonable to assume that other utterances of that speaker should also sound like Scarlet O'Hara. In this case, the new speaker's position in the eigenspace might be labeled "Scarlet O'Hara." Other speakers with similar vocal characteristics would likely fall near the same position within the eigenspace.

Figure 6:
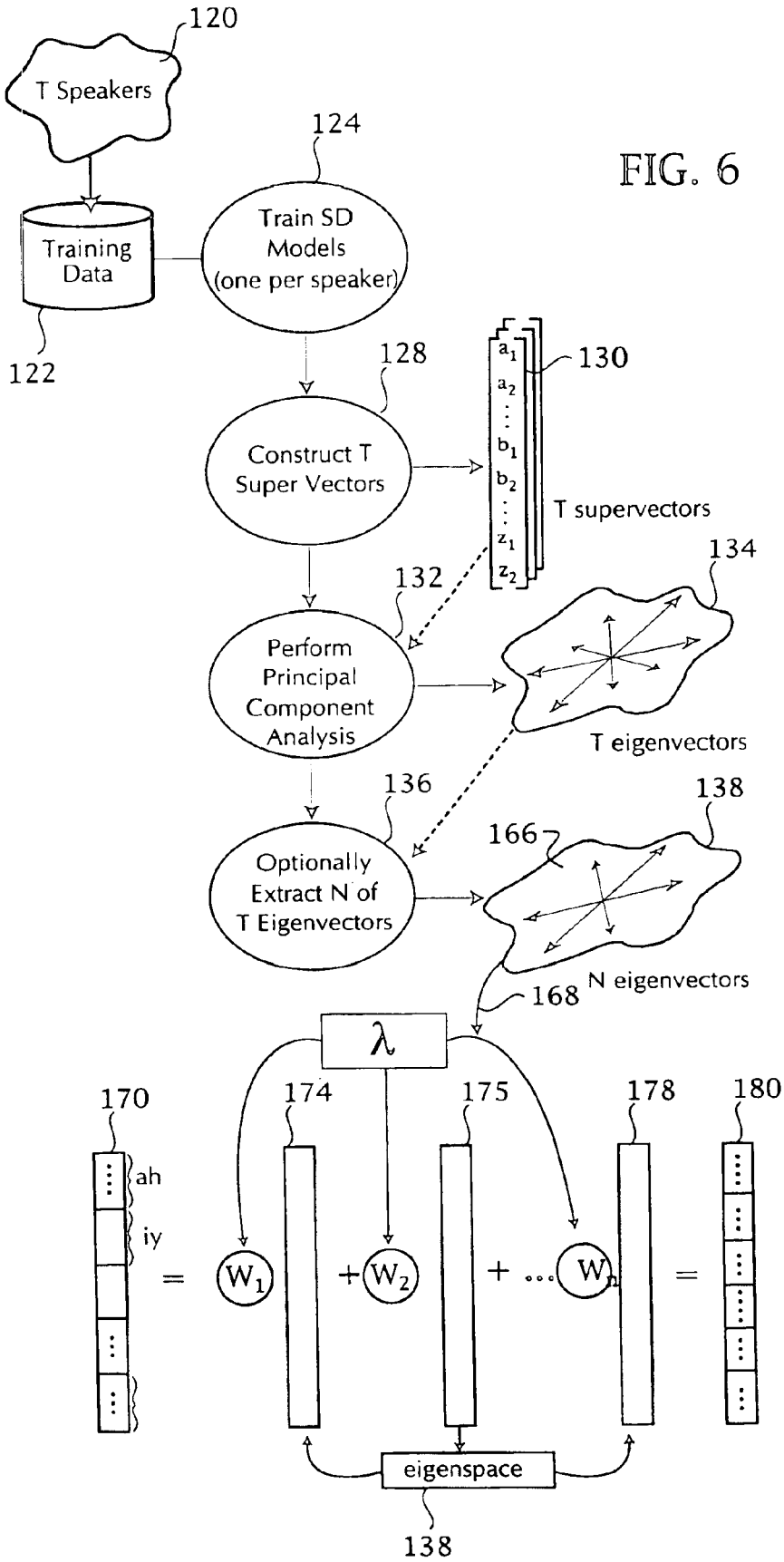
FIG. 6 is a flow diagram illustrating the eigenvector technique for estimating speaker dependent parameters.

The process for constructing an eigenspace to represent context independent (speaker dependent) parameters from a plurality of training speakers is illustrated in FIG. 6. The illustration assumes a number T of training speakers 120 provide a corpus of training data 122 upon which the eigenspace will be constructed. These training data are then used to develop speaker dependent parameters as illustrated at 124. One model per speaker is constructed at step 124, with each model representing the entire set of context independent parameters for that speaker.

After all training data from T speakers have been used to train the respective speaker dependent parameters, a set of T supervectors is constructed at 128. Thus there will be one supervector 130 for each of the T speakers. The supervector for each speaker comprises an ordered list of the context independent parameters for that speaker. The list is concatenated to define the supervector. The parameters may be organized in any convenient order. The order is not critical; however, once an order is adopted it must be followed for all T speakers.

After supervectors have been constructed for each of the training speakers, principle component analysis or some other dimensionality reduction technique is performed at step 132. Principle component analysis upon T supervectors yields T eigenvectors, as at 134. Thus, if 120 training speakers have been used the system will generate 120 eigenvectors. These eigenvectors define the eigenspace.

Although a maximum of T eigenvectors is produced at step 132, in practice, it is possible to discard several of these eigenvectors, keeping only the first N eigenvectors. Thus at step 136 we optionally extract N of the T eigenvectors to comprise a reduced parameter eigenspace at 138. The higher order eigenvectors can be discarded because they typically contain less important information with which to discriminate among speakers. Reducing the eigenspace to fewer than the total number of training speakers provides an inherent data compression that can be helpful when constructing practical systems with limited memory and processor resources.

After the eigenspace has been constructed, it may be used to estimate the context independent parameters of the new speaker. Context independent parameters are extracted from the enrollment data of the new speaker. The extracted parameters are then constrained to the eigenspace using a maximum likelihood technique.

The maximum likelihood technique of the invention finds a point 166 within eigenspace 138 that represents the supervector corresponding to the context independent parameters that have the maximum probability of being associated with the new speaker. For illustration purposes, the maximum likelihood process is illustrated below line 168 in FIG. 6.

In practical effect, the maximum likelihood technique will select the supervector within eigenspace that is the most consistent with the new speaker's enrollment data, regardless of how much enrollment data is actually available.

In FIG. 6, the eigenspace 138 is represented by a set of eigenvectors 174, 175 and 178. The supervector 170 corresponding to the enrollment data from the new speaker may be represented in eigenspace by multiplying each of the eigenvectors by a corresponding eigenvalue, designated $W_1$, $W_2 \ldots W_n$. These eigenvalues are initially unknown. The maximum likelihood technique finds values for these unknown eigenvalues. As will be more fully explained, these values are selected by seeking the optimal solution that will best represent the new speaker's context independent parameters within eigenspace.

After multiplying the eigenvalues with the corresponding eigenvectors of eigenspace 138 and summing the resultant products, an adapted set of context-independent parameters 180 is produced. The values in supervector 180 represent the optimal solution, namely that which has the maximum likelihood of representing the new speaker's context independent parameters in eigenspace.

From the foregoing it will be appreciated that the present invention exploits decomposing different sources of variability (such as speaker dependent and speaker independent information) to apply speaker adaptation techniques to the problem of voice personalization. One powerful aspect of the invention lies in the fact that the number of parameters used to characterize the speaker dependent part can be substantially lower than the number of parameters used to characterize the speaker independent part. This means that the amount of enrollment data required to adapt the synthesizer to an individual speaker's voice can be quite low. Also, while certain specific aspects of the preferred embodiments have focused upon formant trajectories, the invention is by no means limited to use with formant trajectories. It can also be applied to prosody parameters, such as duration and tilt, as well as other phonologic parameters by which the characteristics of individual voices may be audibly discriminated. By providing a fast and effective way of personalizing existing synthesizers, or of constructing new personalized synthesizers, the invention is well-suited to a variety of different text-to-speech applications where personalizing is of interest. These include systems that deliver Internet audio contents, toys, games, dialogue systems, software agents, and the like.

While the invention has been described in connection with the presently preferred embodiments, it will be recognized that the invention is capable of certain modification without departing from the spirit of the invention as forth in the appended claims.

What is claimed is:

1. A method of personalizing a speech synthesizer, comprising:

obtaining a corpus of speech data expressed as a set of parameters useable by said speech synthesizer to generate synthesized speech;

decomposing said set of parameters into a set of speaker dependent parameters and a set of speaker independent parameters;

obtaining enrollment data from a new speaker and using said enrollment data to adapt said speaker dependent parameters and thereby generate adapted speaker dependent parameters by selecting a supervector in an eipenspace trained on speaker dependent parameters of multiple training speakers, said supervector selected to be most consistent with the enrollment data;

combining said speaker independent parameters and said adapted speaker dependent parameters to construct personalized synthesis parameters for use by said speech synthesizer in generating synthesized speech.

2. The method of claim 1 wherein the number of speaker independent parameters exceeds the number of speaker dependent parameters.

3. The method of claim 1 wherein said decomposing step is performed by identifying context dependent information and using said context dependent to represent said speaker independent parameters.

4. The method of claim 1 wherein said decomposing step is performed by identifying context independent information and using said context independent to represent said speaker dependent parameters.

5. The method of claim 1 wherein said speech data comprise a set of frequency parameters corresponding to formant trajectories associated with human speech.

6. The method of claim 1 wherein said speech data comprise a set of time domain parameters corresponding to glottal source information associated with human speech.

7. The method of claim 1 wherein said speech data comprise set of parameters corresponding to prosody information associated with human speech.

8. The method of claim 1 further comprising constructing an eigenspace using speaker dependent parameters from a population of training speakers and using said eigenspace and said enrollment data to adapt said speaker dependent parameters.

9. The method of claim 1 further comprising constructing an eigenspace using speaker dependent parameters from a population of training speakers and using said eigenspace and said enrollment data to adapt said speaker dependent parameters if said enrollment data alone does not represent all phonemes used by the synthesizer.

10. A method of constructing a personalized speech synthesizer, comprising:

providing a base synthesizer employing a predetermined synthesis method and having an initial set of parameters used by said synthesis method to generate synthesized speech;

representing said initial set of parameters as speaker dependent parameters and speaker independent parameters;

obtaining enrollment data from a speaker; and using said enrollment data to modify said speaker dependent parameters and thereby personalize said base synthesizer to mimic speech qualities of said speaker by selecting a supervector in an eipenspace trained on speaker dependent parameters of multiple training speakers, said supervector selected to be most consistent with the enrollment data.

11. A personalized speech synthesizer comprising:

a synthesis processor having a set of instructions for performing a predefined synthesis method that operates upon a data store of synthesis parameters represented as speaker dependent parameters and speaker independent parameters;

a memory containing a data store of synthesis parameters represented as speaker dependent parameters and speaker independent parameters;

an input for providing a set of enrollment data from a given speaker; and an adaptation module receptive of said enrollment data that adapts said speaker dependent parameters to personalize said parameters to said given speaker by selecting a supervector in an eigenspace trained on speaker dependent parameters of multiple training sneakers, said supervector selected to be most consistent with said enrollment data.

12. The synthesizer of claim 11 wherein said synthesis parameters are context independent parameters.

13. The synthesizer of claim 11 wherein said synthesis parameters are context dependent parameters.

14. The synthesizer of claim 11 wherein said input includes microphone for acquisition of said enrollment data from provided speech utterances of said given speaker.

15. The synthesizer of claim 11 wherein said adaptation module includes estimation system employing an eigenspace developed from a training corpus.

16. The synthesizer of claim 15 wherein said enrollment data comprises extracted parameters taken from speech utterances of said given speaker and wherein said estimation system estimates sound units not found in said enrollment data by constraining said extracted parameters from the speech utterance of said given speaker to said eigenspace.

17. A speech synthesis system comprising:

a speech synthesizer that performs a predefined synthesis method by operating upon a data store of decomposed speaker independent synthesis parameters and speaker dependent synthesis parameters;

a personalizer receptive of enrollment data from a given speaker that modifies said speaker dependent synthesis parameters to personalize the sound of the synthesizer to mimic said given speaker's speech, wherein said personalizer extracts speaker dependent parameters from said synthesis parameters and then modifies said speaker dependent parameters using said enrollment data by constraining context independent parameters extracted from said enrollment data to an eigenspace trained on speaker dependent parameters of multiple training speakers using a maximum likelihood technique, thereby estimating context independent parameters of said given speaker by selecting a supervector in the eigenspace that is most consistent with the enrollment data.

18. The system of claim 17 wherein said personalizer decomposes said synthesis parameters into speaker dependent parameters and speaker independent parameters and then modifies said speaker dependent parameters using said enrollment data, and said speech synthesizer performs speech synthesis by combining said speaker independent parameters with modified speaker dependent parameters.

19. The system of claim 17 further comprising parameter estimation system for augmenting said enrollment data to supply estimates of parameters corresponding to sound units that are missing in said enrollment data.

20. The system of claim 19 wherein said estimation system employs an eigenspace trained upon a population of training speakers.

21. The system of claim 19 wherein said estimation system employs an eigenspace trained upon a population of training speakers and uses said eigenspace to supply said estimates of parameters by constraining said enrollment data to said eigenspace.

* * * * *

UNITED STATES PATENT AND TRADEMARK OFFICE

CERTIFICATE OF CORRECTION

PATENT NO. : 6,970,820 B2
DATED : November 29, 2005
INVENTOR(S) : Jean-Claude Junqua et al.

It is certified that error appears in the above-identified patent and that said Letters Patent is hereby corrected as shown below:

Column 8,
Line 32, “eipenspace” should be -- eigenspace --.

Column 9,
Line 17, “eipenspace” should be -- eigenspace --.
Line 37, “sneakers” should be -- speakers --.

Signed and Sealed this

Twenty-eighth Day of March, 2006

JON W. DUDAS
*Director of the United States Patent and Trademark Office*